US006019245A

United States Patent [19]

Foster et al.

[11] Patent Number: 6,019,245

[45] Date of Patent: Feb. 1, 2000

[54] INSULATING DEVICE FOR A BEVERAGE CONTAINER

[75] Inventors: Carla Foster, Norwalk; Donna M. Hardy, Westport, both of Conn.

[73] Assignee: H.B. Bundles, Inc., Southport, Conn.

[21] Appl. No.: 09/045,665

[22] Filed: Mar. 21, 1998

[51] Int. Cl.[7] ..... B65D 33/04; B65D 33/08; B65D 33/10

[52] U.S. Cl. ..... 220/739; 215/11.6; 215/395; 220/592.24; 220/754; 220/903; 224/148.3; 224/148.5; 224/218

[58] Field of Search ..... 220/592.24, 754, 220/758, 903; 215/11.6, 395; 2/159, 158; 224/218, 148.3, 148.5

[56] References Cited

U.S. PATENT DOCUMENTS

| | | | |
|---|---|---|---|
| 1,669,061 | 6/1928 | Meltzer | 215/11.6 X |
| 3,163,194 | 12/1964 | Berry et al. | 215/11.6 |
| 3,605,120 | 9/1971 | Hobbs | 2/159 |
| 4,401,245 | 8/1983 | Zills | 224/148.3 |
| 4,414,692 | 11/1983 | Dzierson et al. | 224/218 X |
| 4,462,444 | 7/1984 | Larson | 215/395 |
| 5,188,877 | 2/1993 | Magaro | 428/80 |
| 5,320,249 | 6/1994 | Strech | 220/739 |
| 5,415,305 | 5/1995 | Drake-Tipton et al. | 220/903 X |
| 5,699,632 | 12/1997 | Stout et al. | 43/25 |

*Primary Examiner*—Allan N. Shoap
*Assistant Examiner*—Joe Merek
*Attorney, Agent, or Firm*—Robert J Doherty

[57] ABSTRACT

An insulating device particularly adapted to fit over the external surface of a generally cylindrical beverage container and including double material layers which provide an internal pocket accessible to the user's fingers through at least one longitudinal entrance slot.

11 Claims, 14 Drawing Sheets

INSULATING DEVICE FOR A BEVERAGE CONTAINER

FIELD OF THE INVENTION

This invention relates to thermal insulating devices for beverage containers to not only insulate the user's hand from direct contact with the outside surface of the beverage container but furthermore to some extent protect the user's hand from the ambient weather as well.

BACKGROUND OF THE INVENTION

It has long been recognized that it is helpful to provide some sort of insulating layer between the outside surface of a beverage container whether it be a beverage container for cold or hot liquids, e.g., soda or coffee, and the user's hand grasping such container. Not only do such devices protect the user's hand or hands from the potential discomfort caused by the hot or cold conditions of the container but further tend to maintain the desired temperature of the beverage container contents when exposed to the ambient outside temperature.

Various constructions have been devised over the years to accomplish these and other desired results including the following constructions shown in U.S. Pat. No. 2,727,241 issued Dec. 20, 1955; U.S. Pat. No. 4,401,245 issued Aug. 30, 1983; U.S. Pat. No. 4,414,692 issued Nov. 15, 1983; U.S. Pat. No. 4,495,659 issued Jan. 29, 1985; and U.S. Pat. No. 4,802,602 issued Feb. 7, 1989.

Despite the existence of these constructions suitable for their stated purposes, there remains a need for a simple holding device for either hot or cold beverage containers which not only insulates the user's hand from a hot or cold container surface but further somewhat protects the user's hand from the ambient temperature as well. Additionally or alternatively, it would also be desirable to provide a simple device for the above stated purpose which by the nature of its contact with the outside surface of the beverage container as well as the absorptive nature of the material from which it is constructed and the layered effect thereof can additionally absorb or prevent condensation which might occur on the container's external surfaces. The absorptive nature of the material helps to stop "dribble" from the beverage since such material absorbs the liquid.

These and other objects of the present invention are accomplished by a device for insulating a hand held beverage container comprising a flexible insulative tubular sleeve having open top and bottom ends to define an internal tubular passage for the receipt of a beverage container, said sleeve having separate inner and outer layers in general face to face opposition to each other, said layers joined together at both said top and bottom sleeve ends with said internal layer being of a continuous circular extent and said second layer being of discontinuous circular extent to define at least one second layer free edge longitudinally extending between said top and bottom sleeve ends, said at least one free edge and the outside surface portion of the inner layer adjacent thereto defining an open longitudinally oriented finger receiving slot, said slot forming the entrance of a finger receiving pocket internally disposed between the outside surface of said inner layer and the inside surface of said outer layer whereby the container may be at least partially grasped by one's fingers positioned in said pocket.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
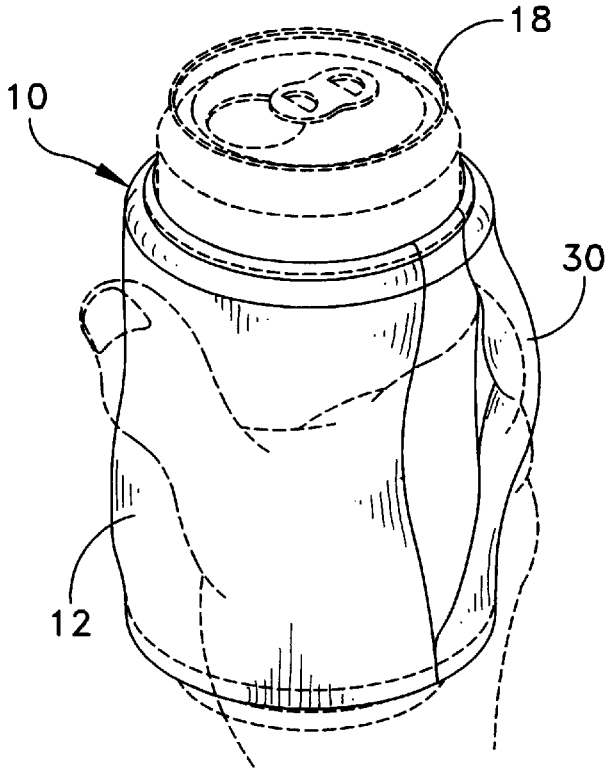
FIG. 1 is a perspective view showing one form of the device of the present invention in use position, that is, surrounding a beverage container and grasped by a human hand—both the container and hand being shown in dotted lines.
Figure 2:
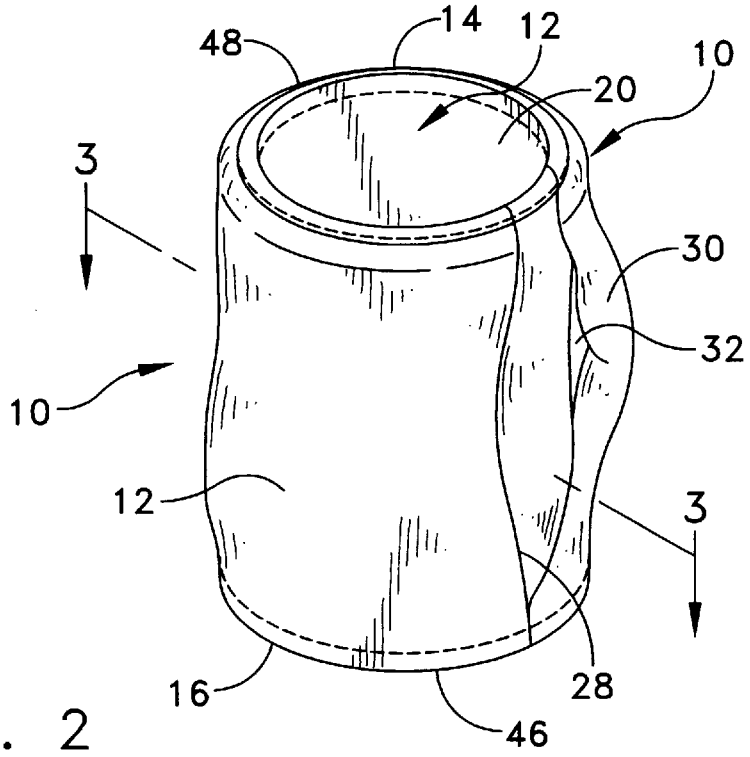
FIG. 2 is a view similar to FIG. 1.
Figure 3:
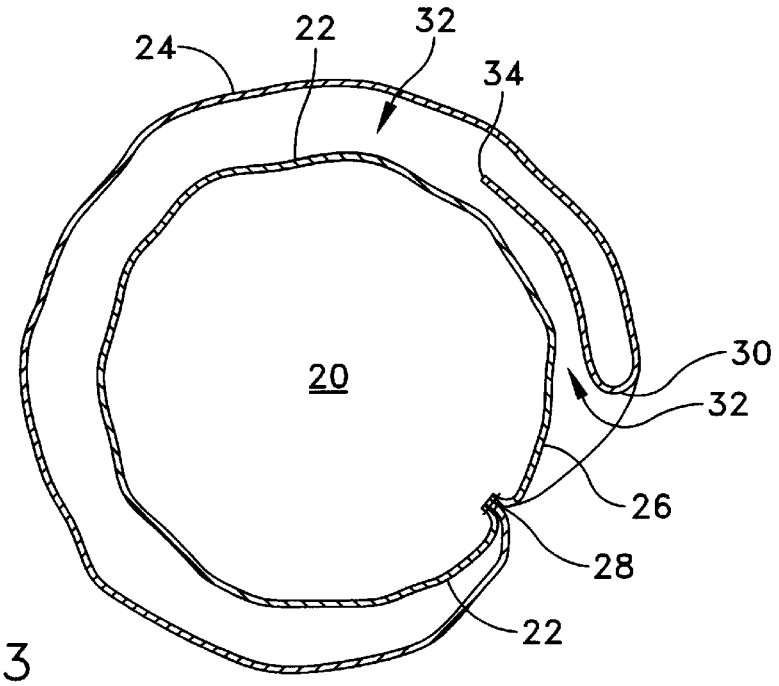
FIG. 3, is a cross sectional view along the lines 3—3 of FIG. 2.

Referring to the drawings and more particularly FIGS. 1 through 3 thereof, one form of the device 10 of the present invention is depicted. As will hereinafter be more fully understood, this embodiment of the device is commonly referred to as the one-handed type meaning that it is particularly adapted for use by one hand of the user rather than both hands combined which will be hereinafter explained with relationship to FIGS. 8 through 14 in connection with the alternative or two-handed embodiment.

The device 10 includes a tubular sleeve 12 open at its upper and lower ends 14 and 16 respectively and adapted to receive a container 18, e.g., a coffee cup adapted to hold hot coffee, a soda container adapted to contain cold soda or some other common container, that is, one of a generally cylindrical configuration. As may be readily seen, the container 18 is adapted for positioning inside the device 10, that is, be received by an internal tubular passage 20 thereof. The height of the device, that is, the extent of the sleeve 12, as well as the tubular passage 20 is determined by the height of the containers normally to be associated therewith such that a significant external surface area of the container is enclosed by the device and also taking into consideration the height of one's hand utilizing, that is, grasping, the device as well as the container positioned therein.

The sleeve 12 is formed by internal 22 and external 24 layers of materials preferably a fabric material such as fleece which is obtainable under the trademark Polartec which is extremely light but insulative, absorptive of water condensation and easily folds and flattens for easy storage and economical shipping. Such material is extremely stain resistant, is machine washable and is environmentally friendly since it is generally made from recycled plastic scrap material and eliminates the need for consumers to use more than one cup for a hot beverage, that is, double the cup to provide insulative protection to one's fingers. Also by generally forming the device from such material, the device can also be easily manipulated in the forming process which normally requires the joining of various surfaces together as by sewing although heat joinder or connection by gluing or the like can also be utilized as well. Also, it is preferable that the device be made of a material which has a low specific gravity such that when it is used in a boating or fishing environment the device will float for easy recovery if lost from the grasp of one's hand. In addition to beverage cans and coffee cups, the device which may be referred to under the trademark Fleece Wrap can be utilized to hold baby bottles, ice cream containers, e.g., a pint container, soup containers or any other hot or cold drink or food in a cup, bottle or other generally cylindrical container.

The internal and external layers 22 and 24 are adapted or otherwise positioned in general face to face position but are joined at the upper and lower ends 14, 16 respectively as by sewing. In addition, the internal layer 22 is circumferentially continuous, that is, it completes a full circle in cross sectional configuration, although it certainly may be flattened or scrunched up into a temporary non-use and non-circular position. The external layer while primarily circular in cross sectional configuration is discontinuous, that is, it does not form a complete 360 degree circle but stops short thereof so as to expose a portion of the internal layer which, in effect, forms a front panel 26 bounded by an edge 28 of the outer layer which is connected to the inner layer as by sewing and a free edge 30 which is not connected to the internal layer 22 except at the upper and lower ends 14 and 16 thereof. In this way then, the free edge 30 forms an entrance to a pocket 32 positioned therebehind and formed by the outside surface of the internal layer 22 and the inside surface of the external layer 24 and into which one may place one or more of their fingers in order to grasp the container as depicted in FIG. 1. It should be pointed out that in such position, the fingers of one's hand are not only protected from direct contact with the outside surface of the container inasmuch as a portion of the internal layer 22 is disposed therebetween but also protected from the ambient air which, of course, could be quite cold therefore and at least those portions of the fingers extending inside the pocket 32 are temperature and wind protected by that portion of the outside layer 24 covering the fingers. It should also be brought out that this construction also traps a significant portion of heat that normally would be released from the outside surface of the container as in the example of grasping a hot cup of coffee in a cold ambient atmosphere.

It should be pointed out that the free edge 30 as shown in FIGS. 1 through 3 is, in fact, a folded edge and that the actual terminal edge 34 of that portion of the outer layer 24 extends a short circumferential distance into the pocket 32. Such a folded edge not only presents a neater appearance but also to some extent reduces wear as by easing the entrance of the fingers slipping in and out of the pocket. In some cases, the actual terminal edge could be the edge that frames the pocket entrance and such could simply be provided for by not folding that edge in the construction process which will hereinafter be more specifically referred to with regard to FIGS. 4 through 7.

The preferred process of forming the device 10 as shown in FIGS. 1 through 3 is best illustrated in the steps set forth in FIGS. 4 through 7. Therein, the cutting, placement, folding, sewing, trimming and manipulating steps performed and their sequence is best illustrated. It should be brought out that in reference to the various views, that the directional orientations referred to, e.g., upper, lower and the like, correspond to their orientation in the views depicted, and it should be pointed out that such orientation varies dependent upon the particular process step referred to, that is, their relative terms are dependent upon the orientation of the device in its completed or partially completed forms.

Figure 4:
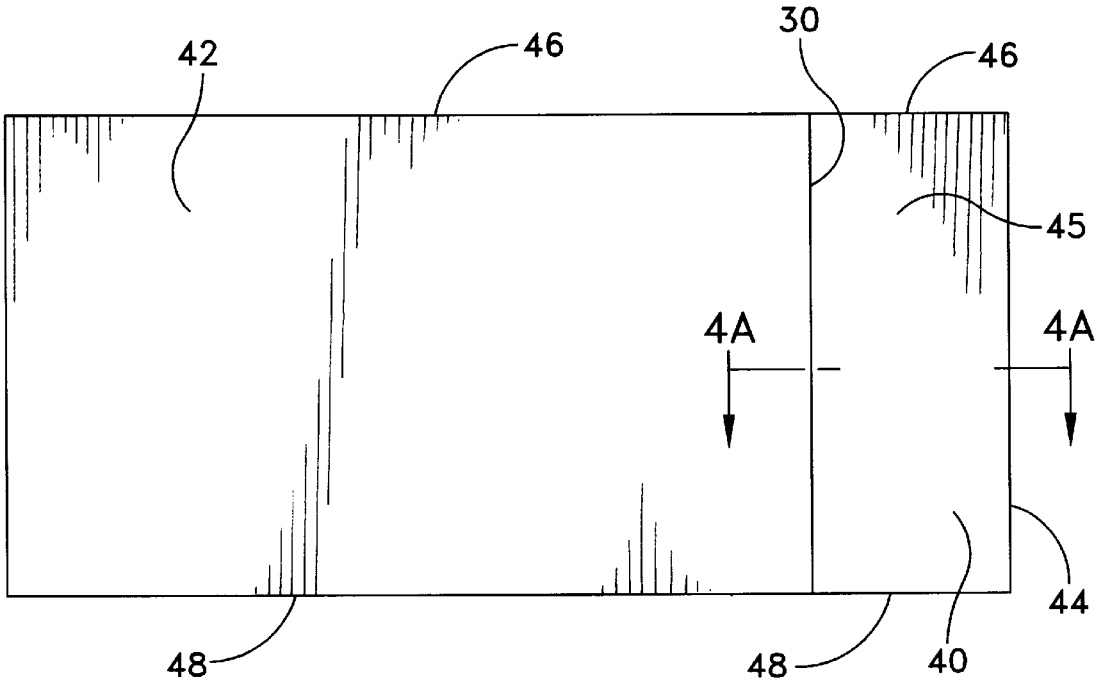
FIG. 4 is a view showing the initial step in forming the device shown in FIG. 1.
Figure 4A:
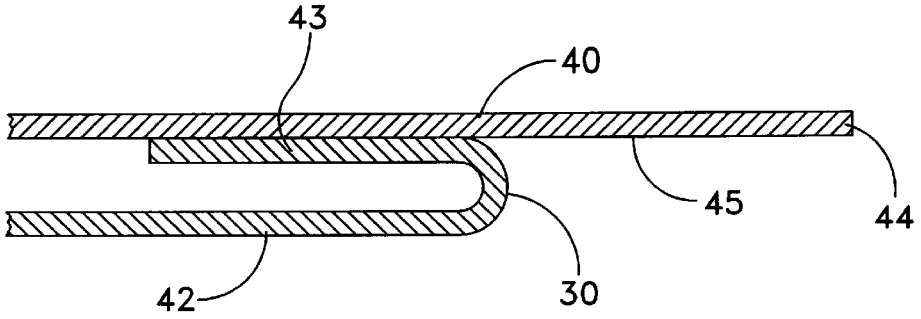
FIG. 4A is a sectional view along the line 4A—4A of FIG. 4.

Referring now to FIG. 4 in particular, the first and second panels 40 and 42 of fabric fleece material are superimposed upon each other with the exception that the uppermost panel 42 has its right hand terminal edge folded under itself so as to present a folded edge displaced from the terminal edge 44 of the lower panel 40 and thus forming a panel portion 43 and a panel portion 45. Obviously, the manipulation steps could take place from right to left rather than left to right as illustrated in the drawings with appropriate modification of the nomenclature. The underfolded edge of the upper panel 40 becomes the terminal edge 34 in the final device 10 as depicted in FIG. 3 while the folded edge becomes the edge 30 thereof. The panels may be approximately 10 inches long and five inches in height and the underfolded panel portion 43 of the upper layer 40 is in the order of 1½ inches although these dimensions are subject to modification both in actual extent and ratio dependent upon the final use of the article.

Figure 5:
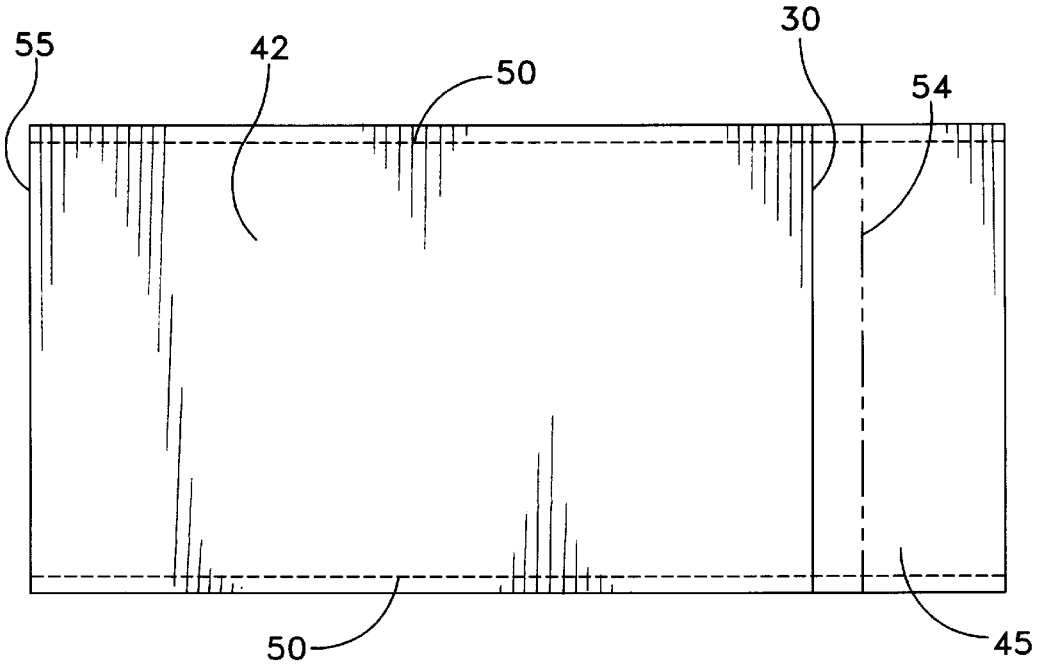
FIG. 5 is a top planar view showing the second step in the formation of the device shown in FIG. 1.

The upper edges 46 as well as the lower edges 48 of the panels 40 and 42 will be generally co-extensive with each other and are sewn together along sewing lines 50 running at the top and bottom thereof as shown in FIG. 5. Thus the panels 40 and 42 are sewn together at their top edges which also includes the underfolded panel portion 43 and the exposed area of panel 40 which, in effect, forms panel portion 45. Thus a double material sewing line will extend from the left of the piece to the edge 34 and thence a triple thickness sewing line from that point to the folded edge 28 and then a sewing line of single thickness for the remainder of the panel portion 45.

Figure 6:
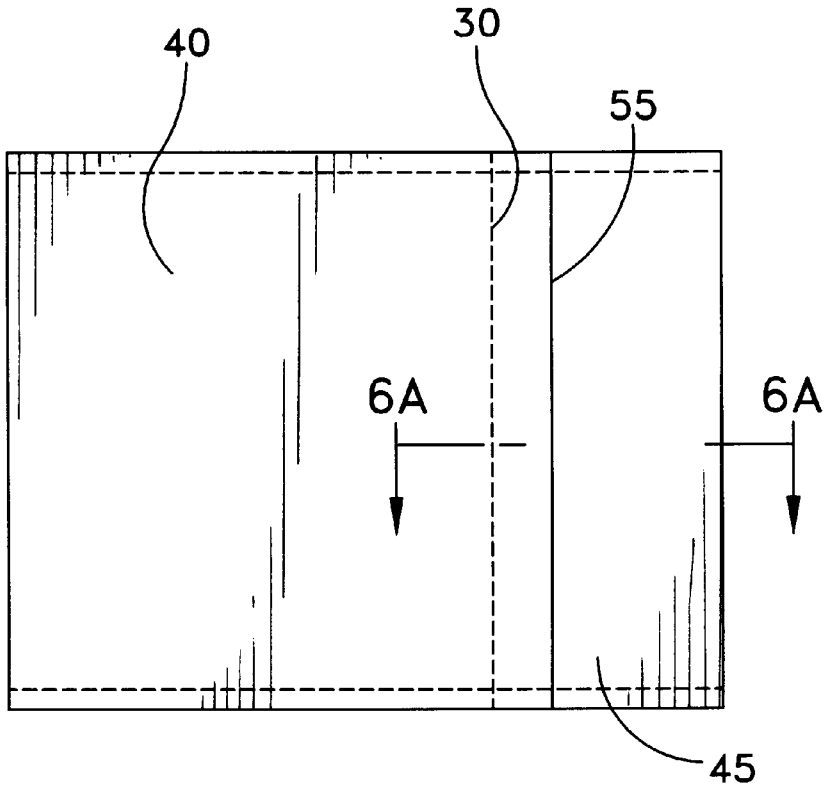
FIG. 6 is a top planar view showing the third step in forming the device of FIG. 1.
Figure 6A:
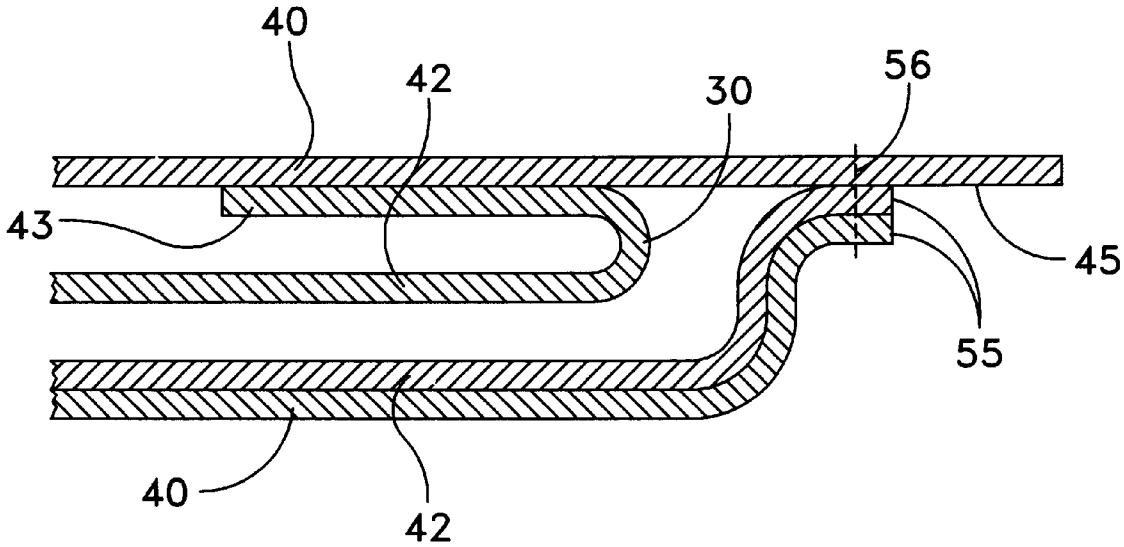
FIG. 6A is a sectional view taken along the line 6A—6A.
Figure 7:
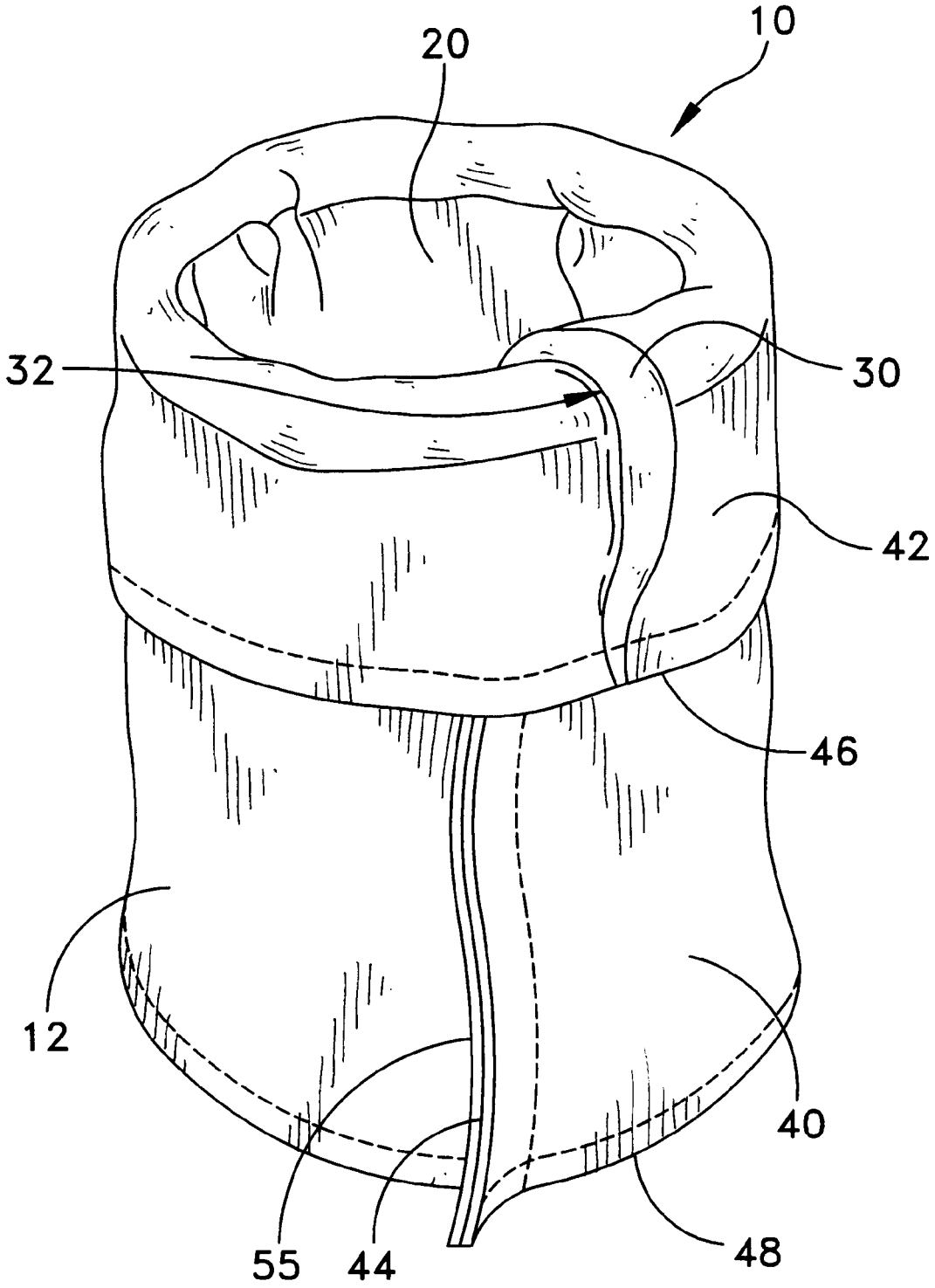
FIG. 7 is a further step in the formation process of the device of FIG. 1 showing the manner in which the device shown in the intermediate step as shown in FIG. 6 is turned inside out to accomplish the device shown in FIG. 1.

It will be noted that in FIG. 5 an imaginary line 54 slightly to the right of the folded edge 28 serves as a guide for the next step in the assembly process. As best shown in FIG. 6, the left hand portion of the composite panels 40 and 42 as sewn together as above described are folded over such that their left hand free edges 55 are positioned along the imaginary line 54 and thence the double thickness of this material (the panels 40 and 42) are sewn by along sewing line 56 to the underlying panel portion or flap 45. The excess material of the flap that is positioned to the right of the sewn line 56 may be cut or trimmed with scissors or the like and discarded or may be left in tact.

The final assembly of the device as shown in FIG. 6 is to turn the entire structure inside out which can be simply accomplished by scrunching together the bottom of the multiple thickness product as shown in FIG. 6 upwardly into and through the internal tubular passage 20 formed by the above indicated sewing and folding procedures. This folding of the partially complete device as shown in FIG. 6 results in the device shown in FIG. 2. Essentially those panel or panel portions originally positioned on the outside of the partially completed product are now positioned on the inside thereof. Also, the folded edge 30 which in the format illustrated by FIG. 6 is covered by the folded over left hand edge portion of the panel portions 40 and 42 is now positioned outermost so as to receive one's fingers into the pocket 32 positioned therebehind. Such pocket 32 extends circumferentially around the outer surface of the internal layer 22 to the point where the sewn line 56 appears in the finished product although the need for one's fingers to extend this amount is certainly not contemplated, the normal extension of the fingers into the pocket being approximately one third of the extent thereof. In some cases, it is desirable to provide an identification tag to the product and such may be simply slipped on top of the panel portion 45 so as to extend across the imaginary line 54 and therefore be, in effect, captured or sewn to the flap 45 by the sewing line 56.

Turning now to FIGS. 8 through 14 of the drawings, an alternate embodiment of the invention is shown which, in essence, is the same as the previous embodiment except there are a pair of finger or thumb or hand receiving pockets 32 and 32A defined by folded edges 30 and 30A and panels 26 and 26A. Generally, the fingers of opposite hands are placed into the two-pocket openings in order to grasp the beverage container positioned within the internal passage 20 rather than the fingers of one hand as in the previous embodiment. Alternatively, the fingers of one hand can be inserted into one of the pockets and the thumb of the same hand in the other pocket.

Figure 8:
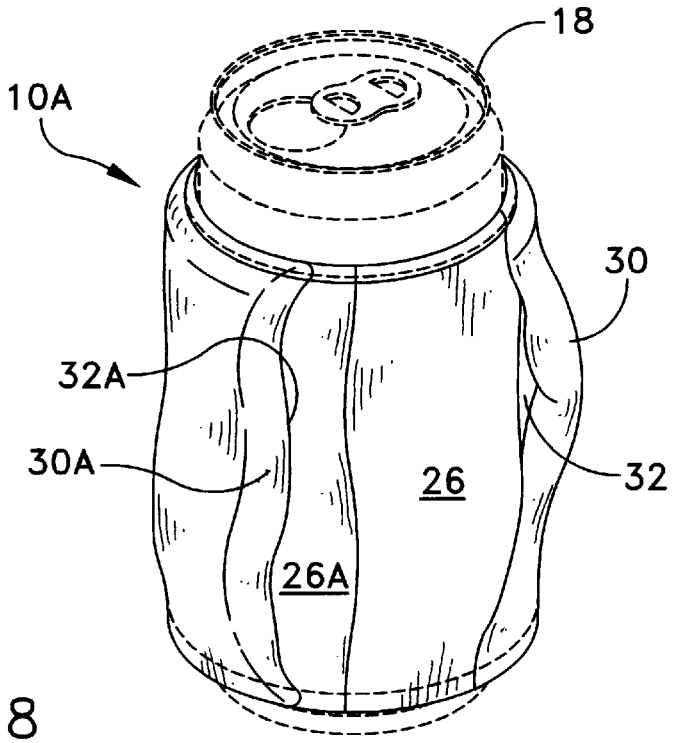
FIG. 8 is a perspective view showing a modified form of the device of the present invention from that shown in FIG. 1 in use position, that is, surrounding a beverage container.
Figure 9:
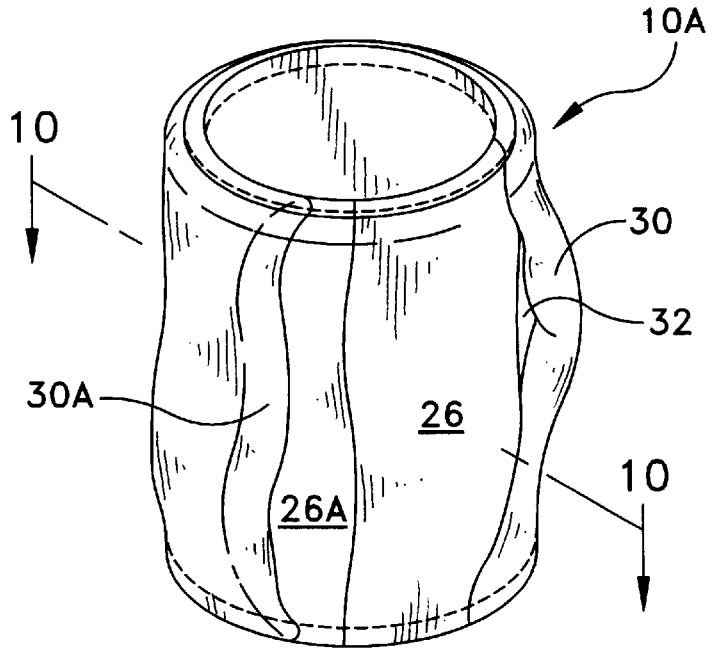
FIG. 9 is a view similar to FIG. 8.
Figure 10:
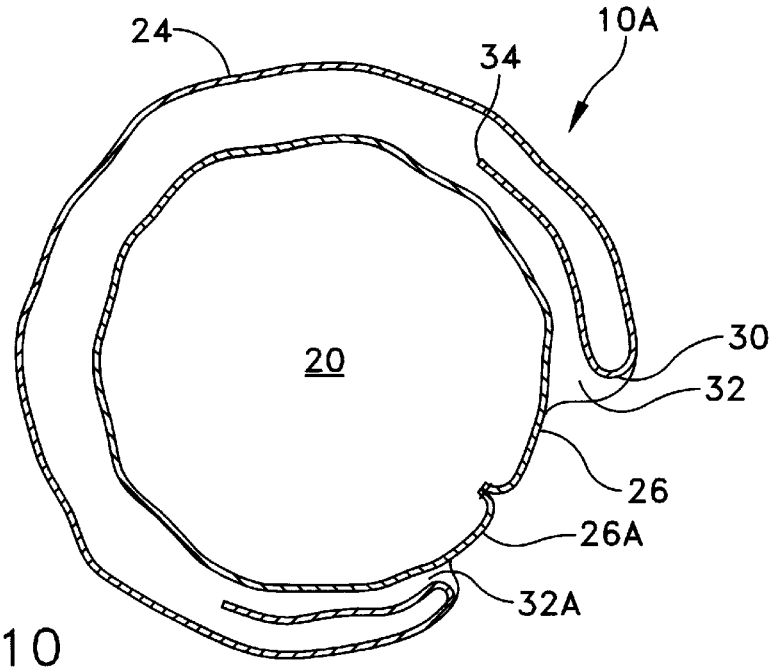
FIG. 10 is a cross sectional view along the lines 10—10 of FIG. 9.
Figure 11:
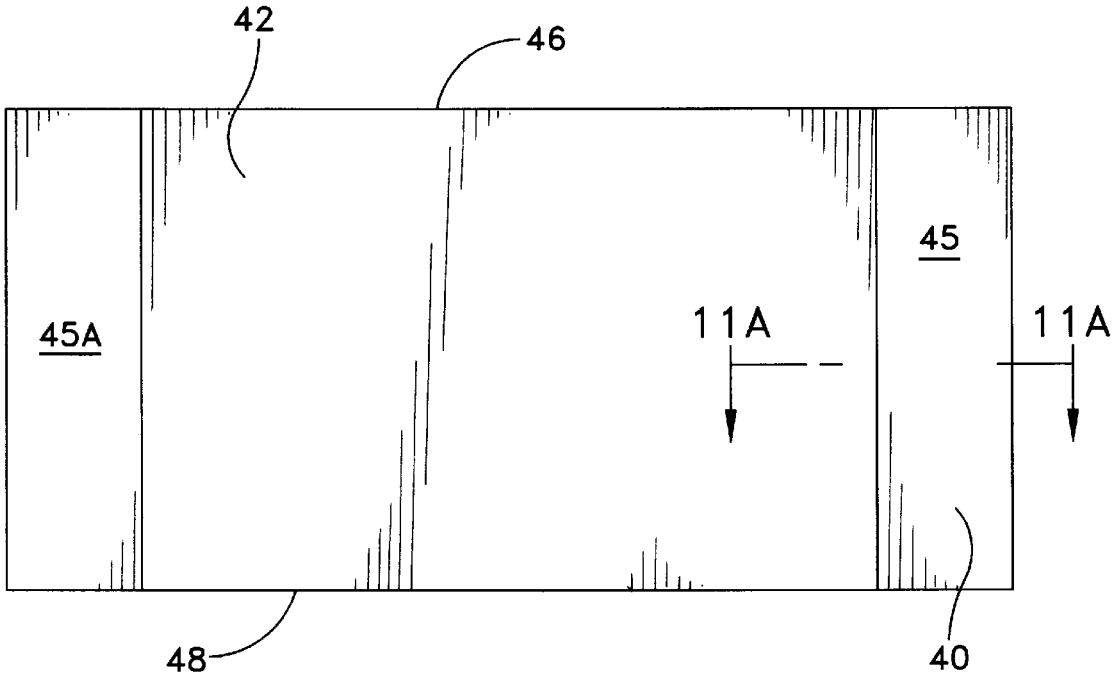
FIG. 11 is a view showing the initial step in forming the device shown in FIG. 8.
Figure 11A:
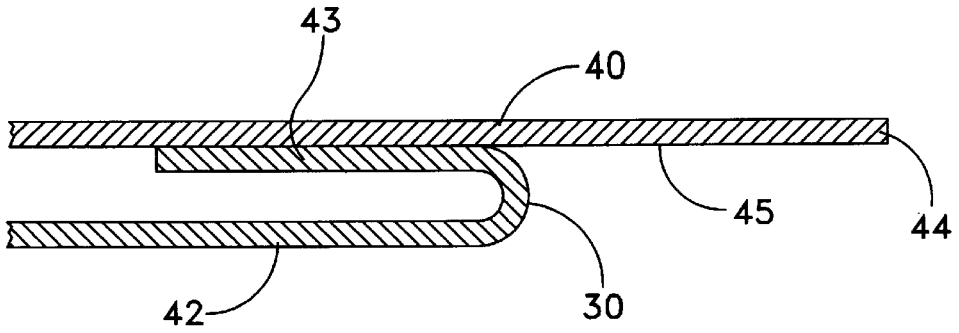
FIG. 11A is a sectional view along the line 11A—11A of FIG. 11.
Figure 12:
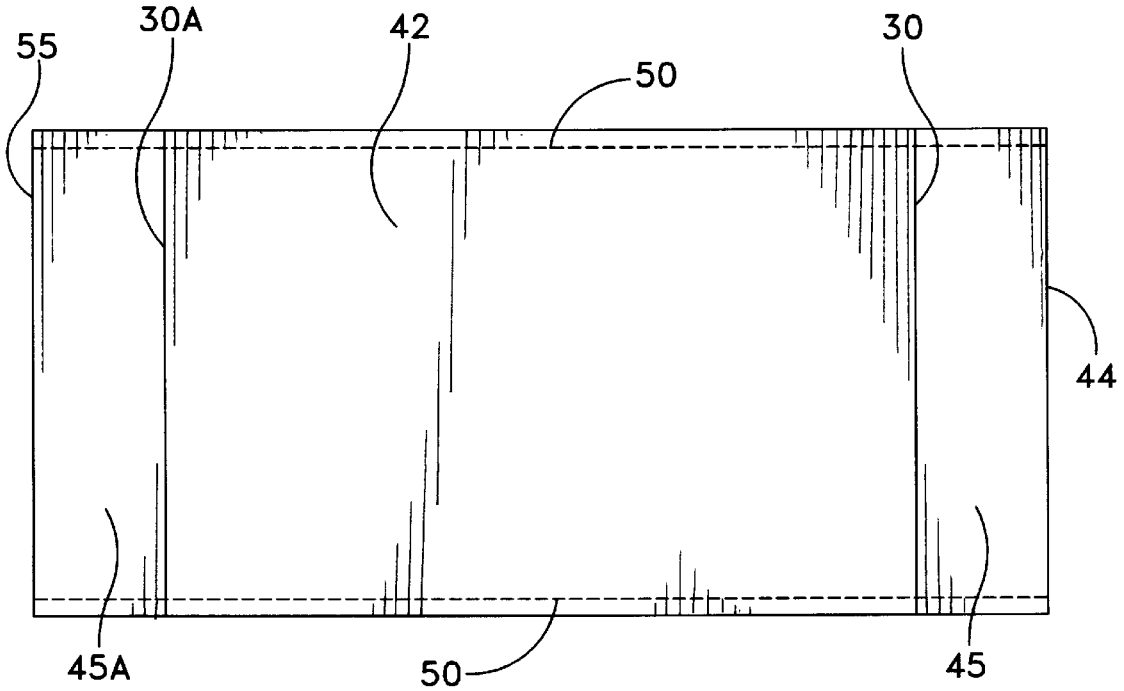
FIG. 12 is a top planar view showing the second step in the formation of the device shown in FIG. 8.
Figure 13:
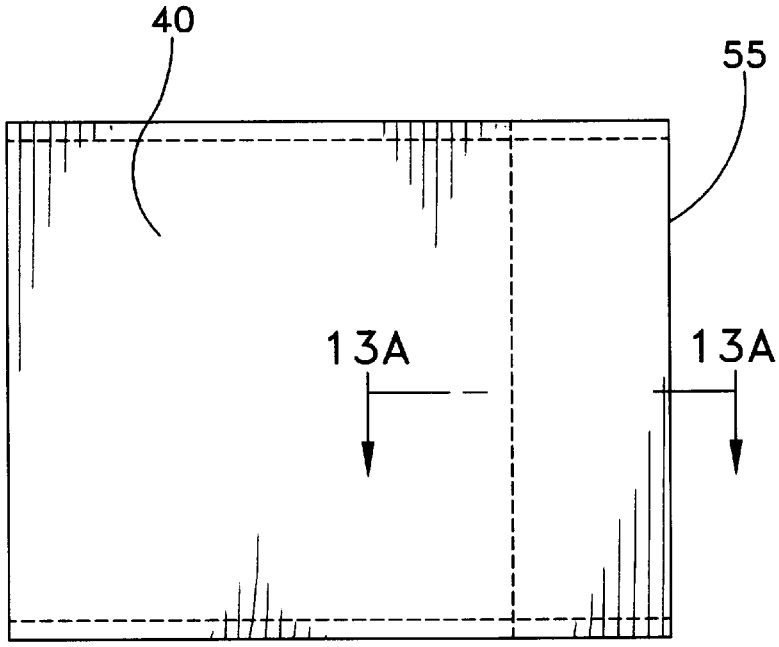
FIG. 13 is a top planar view showing the third step in forming the device of FIG. 8.
Figure 13A:
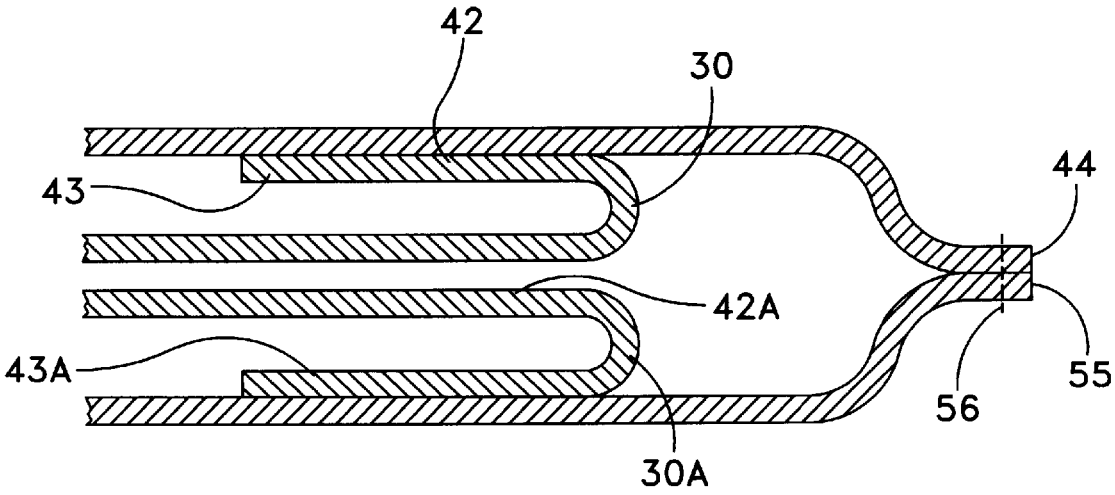
FIG. 13A is a sectional view taken along the line 13A—13A.
Figure 14:
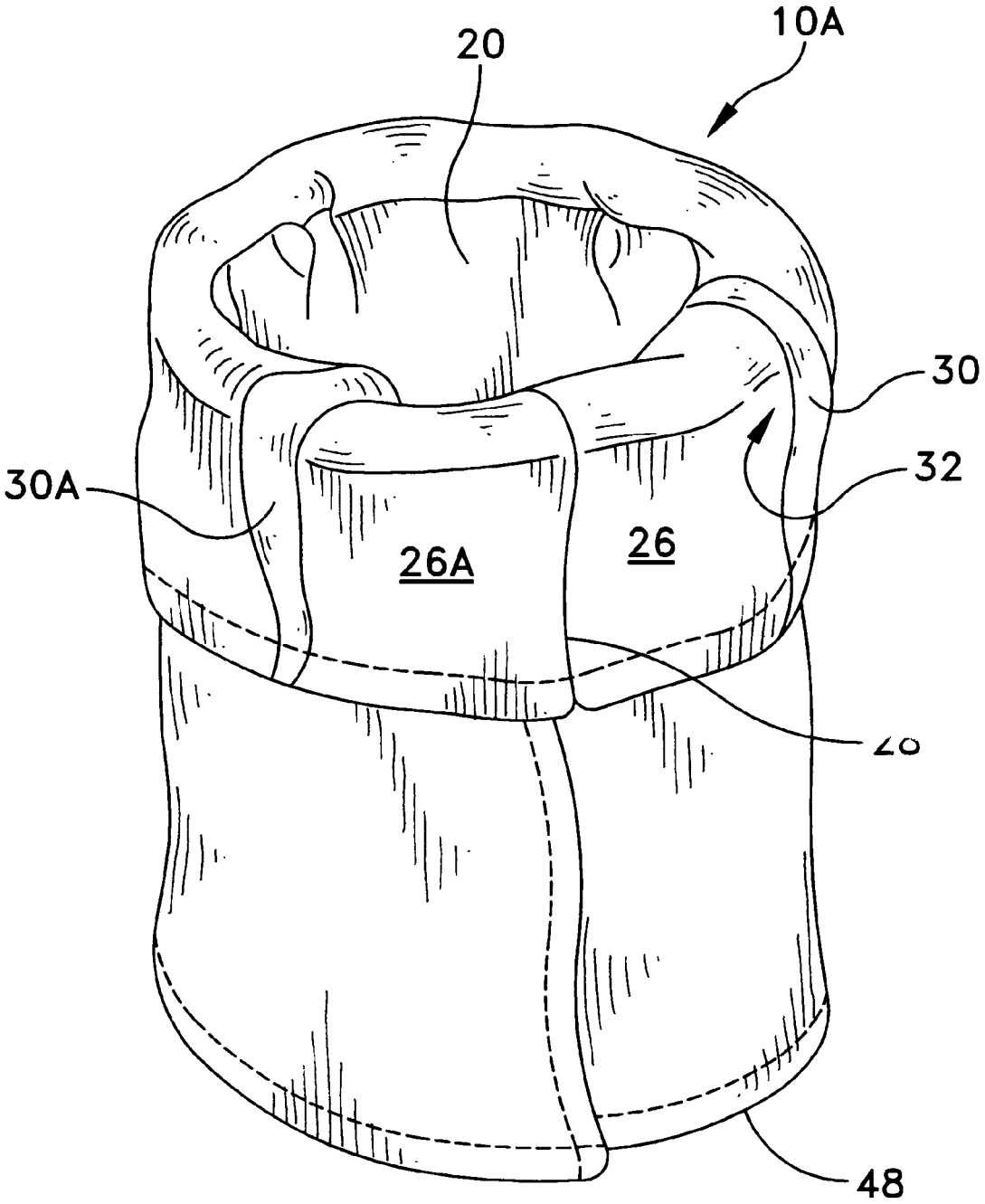
FIG. 14 is a further step in the formation process of the device of FIG. 8 showing the manner in which the intermediate step device as shown in FIG. 13 is turned inside out to accomplish the device shown in FIG. 8.

Turning now to FIGS. 11 through 14, the procedures by which this second embodiment as shown in FIGS. 8 through 10 is formed are best shown. Thus in FIG. 11, the material panels 40 and 42 are positioned as previously indicated but in this case both of the free edges of the top panel 42 are inwardly turned under so as to form panel portions or flaps 43 and 43A on both sides of the upper panel and open panel portions or flaps 45 and 45A on opposite ends thereof. In such folded condition, the bottom and top free edges 46 and 48 of the panels are sewn together as shown in FIG. 12 and then the composite panels folded from left to right such that the free edges of the panels 45 and 45A are aligned and then sewn along line 56A. In this embodiment, there is no extra portion of the panel 45 to be removed as by trimming, and thereafter the composite panel is turned inside out to arrive at the device shown in FIGS. 8 through 10.

It should also be pointed out that in the previously indicated embodiment as shown in FIGS. 1 through 7, that the free edges of the panels 40 and 42 can also be aligned with the free edge of the panel 45 so that no trimming is required or desirable and that such would merely create a larger, that is, panel 26, 26A of larger circumferential extent. Also, it should be pointed out that in both embodiments while preferably described as utilizing folded edges 28 and 30 or 30A alone, that it is not entirely essential that such edges are produced by a fold and that the upper panel could simply be cut of a shorter length and the various procedures performed as above described so as to result in the free edge defining the entrance to the pocket 32 being a terminal, raw or otherwise unfolded edge. With respect to the embodiment shown in FIGS. 1 through 7, that defining pocket edge would, in fact, be the terminal edge 34 under such a modified procedure, but it should be pointed out that the folded edge is far more preferable in that it reduces wear and makes it easier and more comfortable to access the pocket with one's fingers. It should also be noted that in the above embodiments, two panels of material are utilized and such enables enhanced visual effects to be achieved as by selecting panels of different colors and/or designs.

With respect to the other embodiments of the invention especially those that make use of an unfolded edge for defining the pocket edge or edges, it should be pointed out that there are alternate assembly methods to produce such embodiments and two such assembly methods are illustrated in FIGS. 15 through 19 and FIGS. 20 through 25. FIGS. 15 through 19 illustrate a device 10B similar to that shown in FIG. 1 except that it may be formed of a single piece of material and results in a pocket defining edge that is, in effect, one of the lateral terminal edges of the original panel of material. Thus in FIG. 16, a material panel 50 having an upper surface 52, a lower surface 54, opposed side terminal edges 56 and 58 and opposed upper and lower edges 60 and 62 is divided into approximately equal sub-panels A, B, C and D. A suitable size for the panel is 16 inches by 4 inches but as with this and all the other embodiments of the invention, the starting material sizes can widely vary dependent upon the size desired for the final device and the particular use such device is tailored for.

Figure 16:
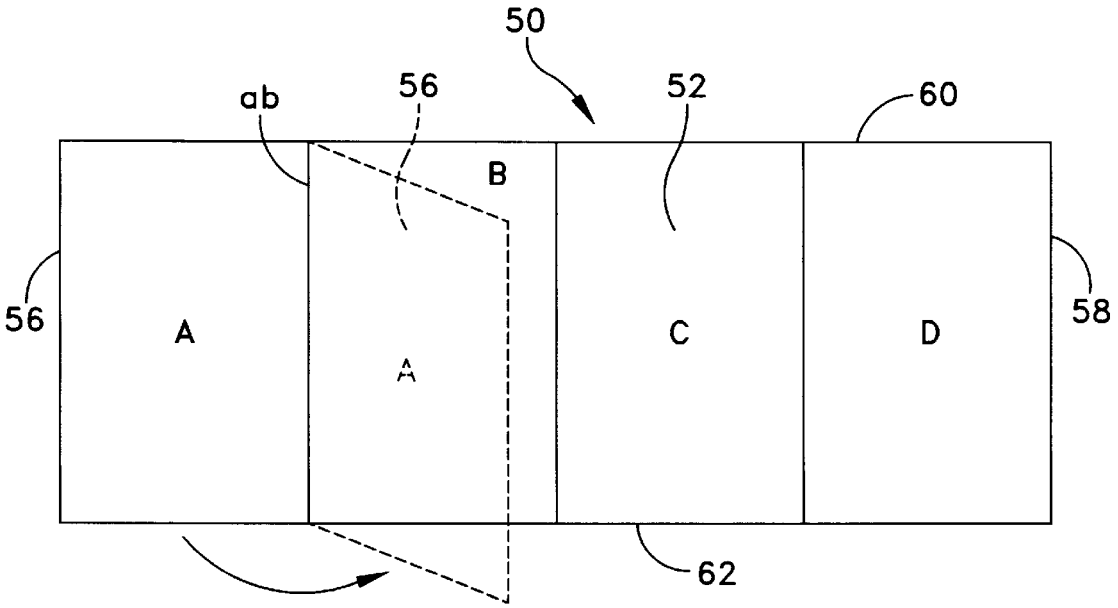
FIG. 16 is a planar view showing the initial step in forming the device shown in FIG. 15.
Figure 17:
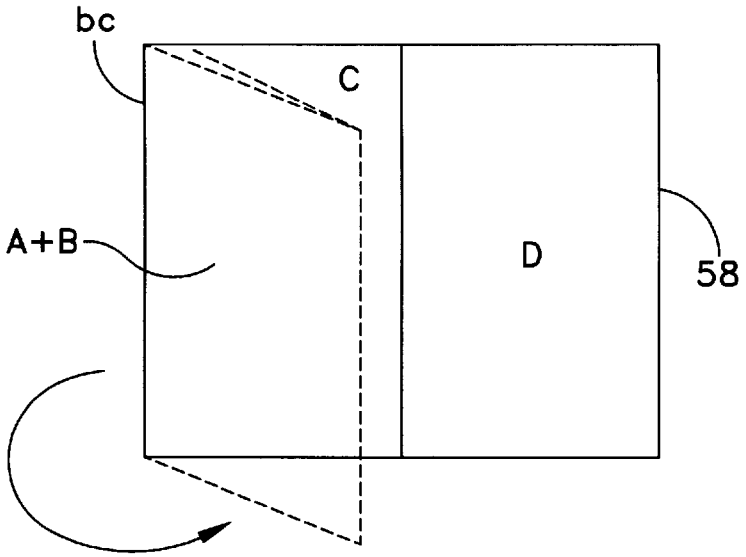
FIG. 17 is similar to FIG. 16 but shows a further step in the process.
Figure 18:
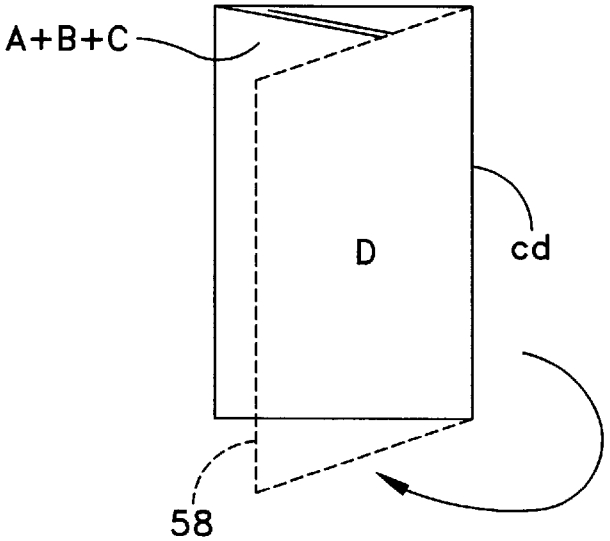
FIG. 18 is also similar to FIG. 16 but shows a still further folding assembly from that shown in FIG. 17.
Figure 19:
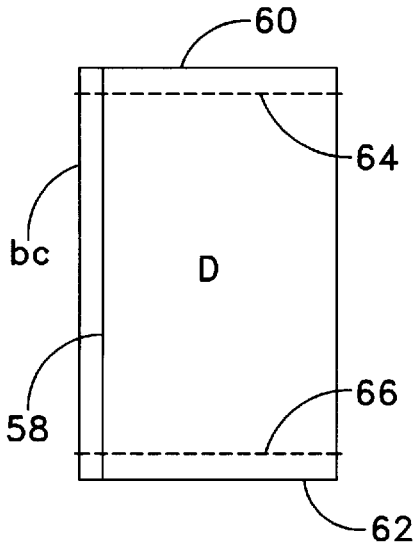
FIG. 19 shows a further step in the formation of the device shown in FIG. 15.
Figure 20:
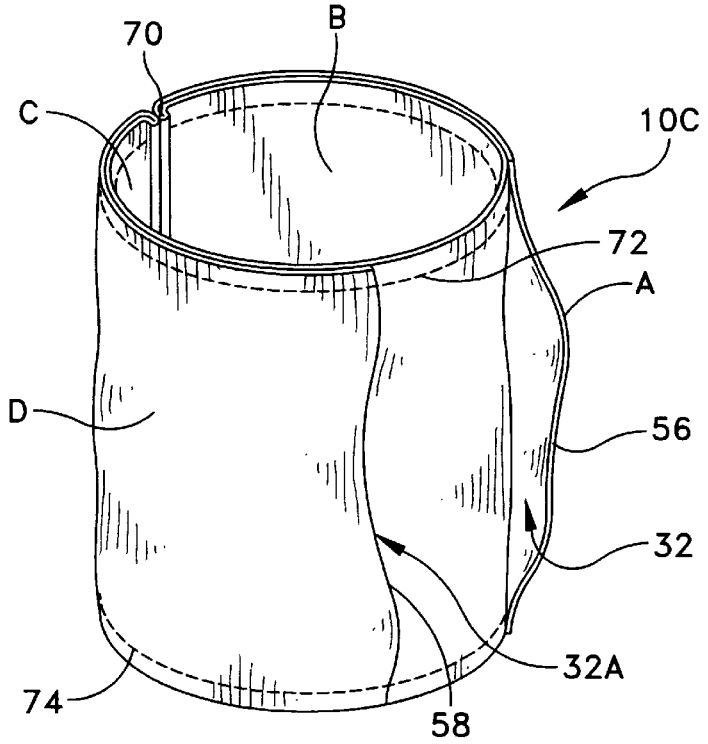
FIG. 20 is a perspective view of still another embodiment of the invention similar to that shown in FIG. 15.

The sub-panels are, in effect, formed by folding the panel 50. As shown in FIG. 16, the first step in the process shown in FIGS. 16 through 19 is to fold sub-panel A along fold line ab over sub-panel B. Then as shown in FIG. 17, the already folded sub-panels A and B are in turn folded along fold line bc over sub-panel C. Thereafter as shown in FIG. 18, the remaining sub-panel D is folded over already folded sub-panels A, B, C and thereafter the outer sub-panels A and C and B and D are joined as by sewing them together along sew line 64 and 66 adjacent to the edges 60 and 62.

Figure 15:
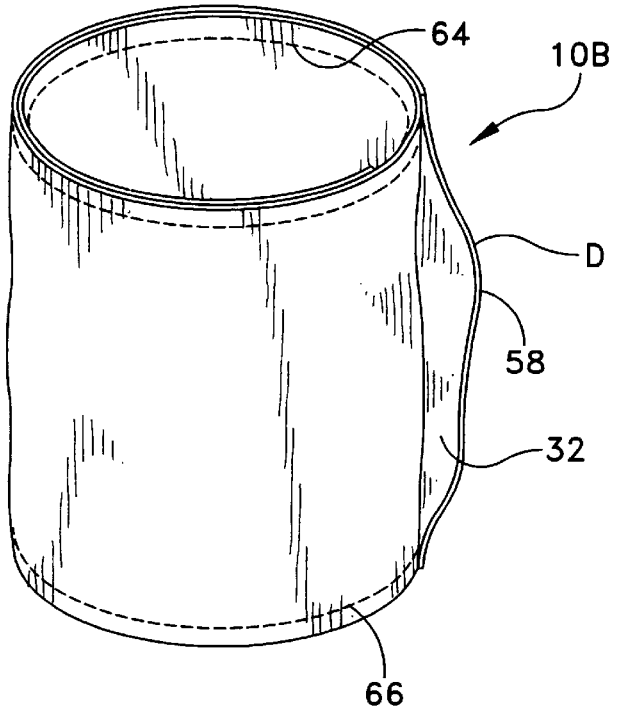
FIG. 15 is a perspective view showing another form of the device of the present invention similar to FIGS. 2 and 9.

The above procedure results in the device 10B shown in FIG. 15 wherein the entrance edge to the pocket 32 is defined by edge 58. Naturally if the panel 50 was folded as above explained but progressively from right to left, then the device 10B would position the pocket to the left side of the device rather than the right side. Alternatively, the completed device 10B can simply be turned 180 degrees to obtain left hand or right hand pocket positions.

Figure 21:
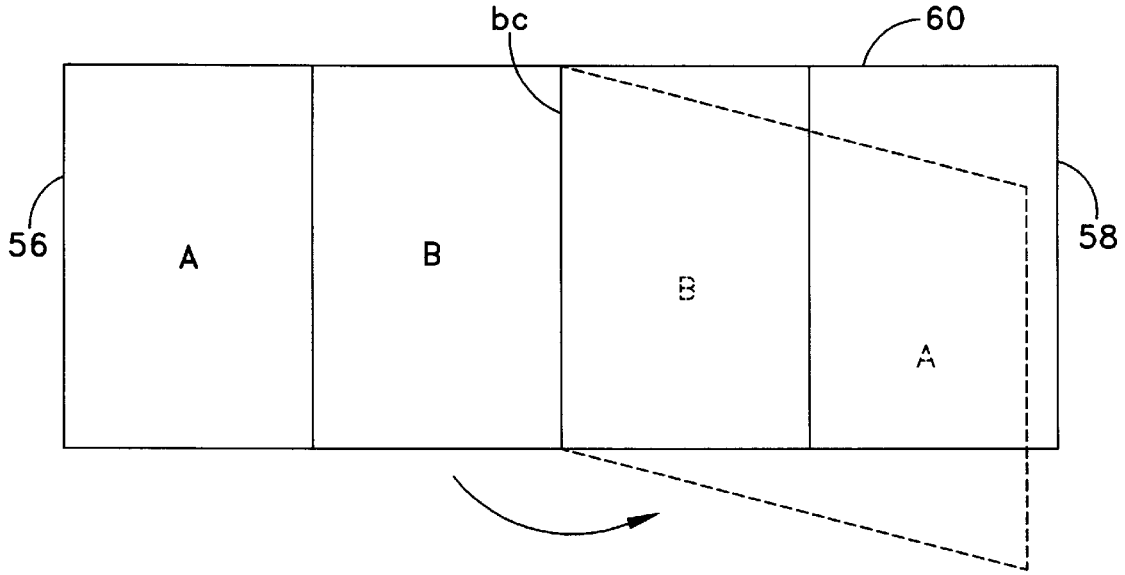
FIG. 21 is a plan view of a piece of material laid out similar to that shown in FIG. 16 and showing the first step in the process of forming the device shown in FIG. 20.
Figure 22:
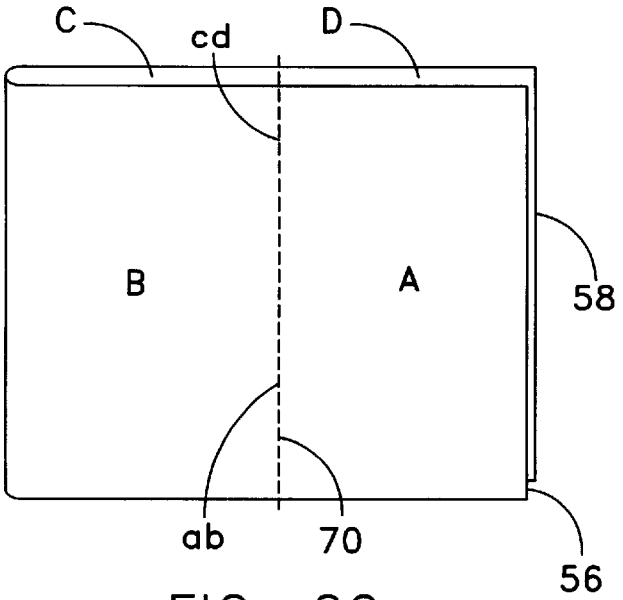
FIG. 22 is a planar view similar to FIG. 21 but showing another step in the process of forming the device of FIG. 20.
Figure 23:
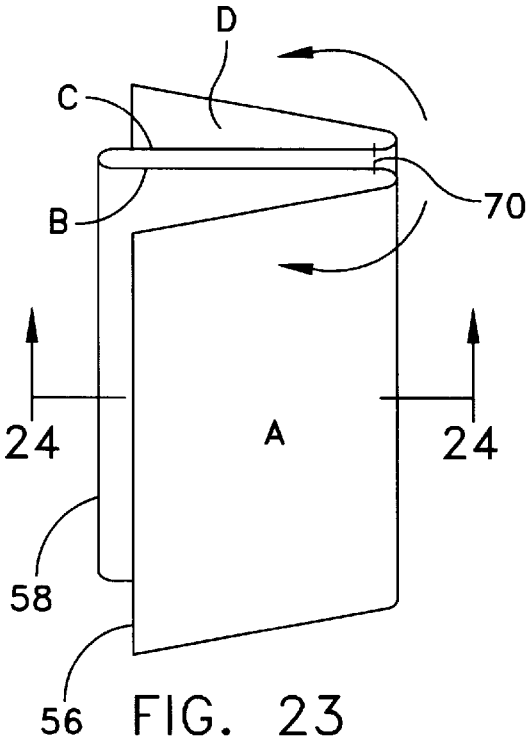
FIG. 23 is similar to FIG. 22 but shows a still further step or steps in the procedure leading to the device of FIG. 20.
Figure 24:
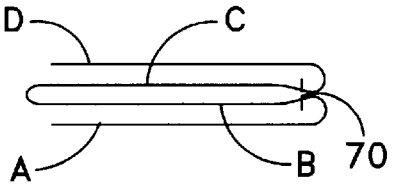
FIG. 24 is a top sectional view through the line 24—24 of FIG. 23 and shows the relationship of the various layers to one another.
Figure 25:
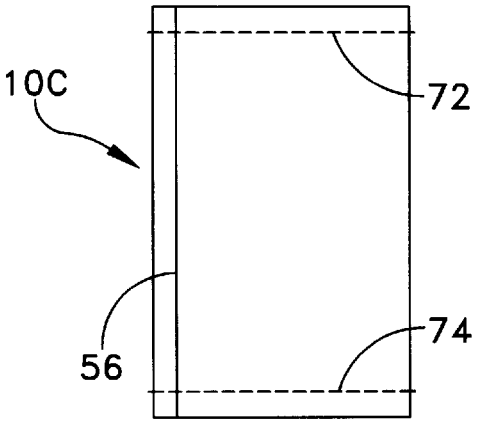
FIG. 25 is the final step in the procedure of forming the device shown in FIG. 20.

Turning now to the double pocket device 10C embodiment of FIGS. 20 through 25, the panel 50 may again be of the general size and configuration as in the FIGS. 15 through 19 embodiment and also divided into sub-panels A, B, C and D. The folding and attachment as by sewing steps are as shown in the drawing progression of FIGS. 21 through 24. Thus, as shown in FIG. 21, the left edge 56 and sub-panels A and B are folded along fold line bc to overlay sub-panels C and D with the edges 56 and 58 generally aligned. The sub-panels are then attached together as by sewing along a vertical sew line 70 which roughly corresponds to the division between sub-panels A and B and sub-panels C and D. This, in effect, forms the tubular passage 20 for receipt of the article (soda can, coffee cup, etc.) to be positioned therein in the intended manner. Thereafter, sub-panel A is folded to the left over sub-panel B along sew line 70 (fold line ab) and sub-panel D folded under sub-panel C also along sew line 70 (fold line cd). Thereafter, the then outwardly positioned sub-panels A and B and C and D are joined as by sewing along sew lines 64 and 66 adjacent the edges 60 and 62 which results in the device 10C shown in FIG. 20 wherein the entrance edge of the pockets 32 and 32A are defined by edges 56 and 58 respectively.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for insulating a hand held container comprising a flexible insulative tubular sleeve having open top and bottom ends to define an internal tubular passage for the receipt of a container, said sleeve having separate inner and outer layers in general face to face opposition to each other, said layers joined together at both said top and bottom sleeve ends with said inner layer being of a continuous circular and axial extent between and from said top and bottom ends and said outer layer being of discontinuous circular extent to define at least one outer layer free edge longitudinally extending between said top and bottom sleeve ends, said at least one free edge and the outside surface portion of the inner layer adjacent thereto defining an open longitudinally oriented finger receiving slot, said slot forming the entrance of a finger receiving pocket internally disposed between the outside surface of said inner layer and the inside surface of said outer layer whereby the container may be at least partially grasped by one's fingers positioned in said pocket, and wherein said outer layer covers a majority of the outside surface of said inner layer.

2. The device of claim 1, said free edge being a folded portion of said external layer and with said folded external layer portion positioned within said pocket.

3. The device of claim 1, including a pair of free edges laterally spaced from each other and each in part defining an open longitudinally oriented finger receiving slot.

4. The device of claim 3, said free edges both being separate terminal folded portions of said external layer.

5. The device of claim 1, wherein said layers are each a flexible insulating fabric material.

6. The device of claim 5, said fabric material being fleece.

7. The device of claim 1, said free edge being an unfolded single terminal edge of said external layer.

8. The device of claim 3, said free edges both being separate unfolded terminal edges of said external layer.

9. The device of claim 1, wherein said layers are additionally joined together by a longitudinally oriented connecting line, said longitudinally oriented connecting line disposed within said finger receiving slot.

10. The device of claim 9, said longitudinally oriented connecting line being a sewn line.

11. The device of claim 1, wherein said layers are additionally joined together by a longitudinally oriented connecting line, said longitudinally oriented connecting line disposed at a position opposed to said finger receiving slot.

* * * * *